US006989079B2

(12) United States Patent
Johnson et al.

(10) Patent No.: US 6,989,079 B2
(45) Date of Patent: Jan. 24, 2006

(54) HIGH SUPPORT DOUBLE LAYER FORMING FABRIC

(75) Inventors: Dale Johnson, Ottawa (CA); Richard Stone, Carleton Place (CA)

(73) Assignee: AstenJohnson, Inc., Charleston, SC (US)

( * ) Notice: Subject to any disclaimer, the term of this patent is extended or adjusted under 35 U.S.C. 154(b) by 156 days.

(21) Appl. No.: 10/250,764

(22) PCT Filed: Nov. 27, 2002

(86) PCT No.: PCT/CA02/01815

§ 371 (c)(1),
(2), (4) Date: Jul. 7, 2003

(87) PCT Pub. No.: WO03/046277

PCT Pub. Date: Jun. 5, 2003

(65) Prior Publication Data

US 2004/0094223 A1 May 20, 2004

(30) Foreign Application Priority Data

Nov. 27, 2001 (GB) ..... 0128407

(51) Int. Cl.
*D21F 1/10* (2006.01)
*D03D 3/04* (2006.01)
*D03D 13/00* (2006.01)

(52) U.S. Cl. ..... 162/348; 162/903; 139/383 A; 442/205; 442/207

(58) Field of Classification Search ..... 162/109–117, 162/306, 348, 358.1, 358.2, 358.4, 900–904; 139/383 A, 425 A; 442/203–207
See application file for complete search history.

(56) References Cited

U.S. PATENT DOCUMENTS 5,022,441 A * 6/1991 Tate et al. ..... 139/383 A (Continued)

FOREIGN PATENT DOCUMENTS

EP 0 264 881 A1 4/1988

(Continued)

*Primary Examiner*—Eric Hug
(74) *Attorney, Agent, or Firm*—Shapiro Cohen

(57) ABSTRACT

A double layer forming fabric for a paper making machine is woven to an overall repeating pattern, which comprises in combination paper side layer weft yarns, machine side layer weft yarns, and warp yarns. The paper side layer weft yarns interweave with the warp yarns in a first repeating weave pattern, the machine side layer weft yarns interlace with the warp yarns in a second repeating weave pattern, and the fabric is woven in an overall repeating pattern requiring 3N sheds, in which N is an integer and is at least 2. For each warp yarn, the first repeating weave pattern includes interweaving locations comprising a first and a second interweaving point, each of the interweaving points being separated by an internal warp float of at least two paper side layer weft yarns. For each warp yarn, the second repeating weave pattern includes a series of interlacing points in which each interlaced machine side layer weft yarn also passes substantially below an interweaving location of paper side layer weft yarns and each adjacent warp yarn. In addition, for each warp yarn, each of the first and second interweaving points with a paper side layer weft yarn is separated from an adjacent machine side layer interlacing point by at least two machine side layer weft yarns. The machine side face of the machine side layer includes exposed machine side layer weft yarn floats having a float length L defined as L=3N−M, wherein M is an integer and is at least 1.

15 Claims, 9 Drawing Sheets

U.S. PATENT DOCUMENTS 5,502,120 A * 3/1996 Bhatt et al. ..... 525/440
5,857,498 A * 1/1999 Barreto et al. ..... 139/383 A
6,112,774 A 9/2000 Wilson
6,202,705 B1 * 3/2001 Johnson et al. ..... 139/383 A
6,240,973 B1 * 6/2001 Stone et al. ..... 139/383 A
6,413,377 B1 * 7/2002 Wright ..... 139/383 A
6,581,645 B1 * 6/2003 Johnson et al. ..... 139/383 A

FOREIGN PATENT DOCUMENTS

EP 0 549 917 A1 7/1993
GB 2 351 505 A 1/2001
WO WO 01/42558 A1 6/2001

* cited by examiner

HIGH SUPPORT DOUBLE LAYER FORMING FABRIC

FIELD OF THE INVENTION

This invention relates to a double layer forming fabric, consisting of a single set of warp yarns, and two layers of weft yarns, for use in the forming section of a paper making machine.

BACKGROUND OF THE INVENTION

In the forming section of a paper making machine, an aqueous stock is deposited onto the paper side surface of a moving forming fabric. The machine side surface of the forming fabric is in contact with the static fabric support elements in the forming section of the paper making machine. The forming fabric allows water to drain from the stock, and retains a proportion of the paper making solids in the stock on its surface to form an incipient paper web.

It has been found that the desirable characteristics for such fabrics are to a degree mutually incompatible, both in achieving an acceptable balance between the drainage, formation and retention properties of the fabric, and in other factors affecting the selection of weave patterns to achieve optimal properties for the paper side and the machine side of the forming fabric. The forming fabric must be capable of withstanding the mechanical and abrasive stresses imposed on it, which, in modern paper making machines where the forming fabric moves at a speed in excess of 70 kph, are substantial. To produce acceptable quality paper, the forming fabric should not cause marking, known as wire mark, on the sheet, and the percentage of the paper solids in the stock retained in the incipient paper web, known as first pass retention, should be as high as possible. In order to achieve a high first pass retention, the forming fabric must have good drainage characteristics and low water carrying properties, so that the removed water is readily transported through the fabric, without excessive drainage and loss of the paper solids. The fabric should also provide a uniform, planar support surface onto which the stock is delivered so that the paper making fibres are evenly supported by the component yarns of the paper side surface and the resulting sheet does not exhibit substantial variation in its fibre distribution and is stated to be "well-formed". In addition, as a significant proportion of the fibres in the stock delivered onto the moving forming fabric tend to be oriented in the machine direction of the forming fabric, the fabric should provide adequate fibre support in the cross machine direction.

The need for a high drainage rate calls for a fabric with an open weave, but such a weave tends to cause wire mark and the incipient paper web tends to be formed somewhat in, rather than mostly on, the forming fabric paper side surface. A closely woven fabric provides better paper support and results in good first pass retention, and the paper is formed on, rather than somewhat in, the fabric, and is thus easier to release from the forming fabric. However, a closely woven fabric drains relatively poorly.

It has been found that improved drainage and fibre support characteristics can be achieved by ensuring that the frame openings in the paper side layer are substantially regular, and if the openings are rectangular, it is preferable that the longer side be oriented in the cross-machine direction. However, a related factor is the undesirable effect of forces which tend to induce adjacent pairs of weft yarns to move closer together, creating an asymmetry, known as "twinning". This reduces alignment and registration of the paper side and machine side yarns, and the resulting different sized drainage passages adversely affect paper quality. Various methods have been suggested to resolve this problem.

Wilson, in U.S. Pat. No. 6,112,774, suggests that twinning results from excessive tension in machine direction yarns where those yarns interlace in the machine side layer with the cross-machine direction yarns in an "under 1, over 1, under 1" configuration, for example in the zig-zag -machine side layer weave pattern disclosed by Wright in U.S. Pat. No. 5,025,839. Wilson discloses a weave pattern which maintains the zig-zag pattern of Wright for the machine side layer, but suggests an arrangement of alternating machine direction yarns, in which the machine side layer interlacing points on adjacent machine direction yarns are offset by at least two cross machine direction yarns, as a means of reducing tension in the machine direction yarns.

Nevertheless, it has been found that twinning of paper side layer weft yarns continues to occur in weave patterns such as disclosed by Wilson in U.S. Pat. No. 6,112,774. Wilson further suggests, in WO 01/59208, that cross-machine direction yarns can be maintained in their original positions, i.e. that twinning can be reduced, by the use of suggested preferred materials for the manufacture of the machine direction yarns. These materials are said to encourage crimping, particularly where the machine direction yarns interweave with the cross machine direction yarns in an "over 1, under 1, over 1, under 1, over 1" configuration.

However, it has recently been found that twinning of paper side layer weft yarns adjacent to interweaving points in that layer can be avoided, or significantly reduced, in a double layer fabric, by using weave patterns which do not involve the close proximity of interweaving points on adjacent paper side layer warp yarns. This advantage is further enhanced where the weave pattern additionally does not involve the close proximity on a single warp yarn of the last one of a series of interweaving points in the paper side layer and an immediately adjacent interlacing point in the machine side layer. It has thus been found that the undesirable twinning effect can be significantly reduced by providing a weave pattern which maximizes the distance between interweaving points in the paper side layer on adjacent warp yarns, while increasing the internal float length of the warp yarns between the interweaving points on the paper side layer and the interlacing points on the machine side layer.

The degree of twinning of adjacent yams can be described in terms of the ratio of the difference of the distance (W) between one of a specific twinned pair of yarns and the adjacent non-twinned yarn, and the distance (T) between the twinned yam pair, to the distance W. This can be expressed as the ratio (W−T):W; or as a percentage (W−T)/W×100.

In a fabric with minimal twinning, this ratio would approach 0:1, or 0%; whereas in a highly twinned fabric, this ratio can be as high as 1:2, or 50%. It has been found for the fabrics of this invention that the ratio can be reduced to at least 0.1:1, or 10%, and more preferably can be reduced to between 0.05:1 and 0:1, or 5% to 0%.

The reduction of the twinning of the paper side weft yarns, together with the fact that all of the paper side layer weft yarns contribute to the support of the paper making fibres, leads to a greater regularity in the frame openings on the paper side surface of the paper side layer, and hence to a corresponding greater uniformity in the fibre support. It is well known that the overall frame size and the frame length in the machine direction are important parameters in the design of forming fabrics, and these topics are discussed by Helle, Torbjorn, "Fibre Web. Support of the Forming Wire",

*Tappi Journal*, Vol. 71, No. 1 (January 1988), pp. 112–117; and Johnson, D. B., "Retention and Drainage of Forming Fabrics", *Pulp & Paper Canada,* Vol 85, pp. T167–172 (1984). The authors indicate that frame opening configurations have a significant influence on the drainage of the incipient paper web, and on the first pass retention characteristics of the forming fabric. It has been found that greater cross machine direction support is achieved by the use of designs having rectangular frame openings.

It has previously been considered that drainage problems in double layer forming fabrics result from the use of weave patterns requiring more than 8 sheds in the loom. For example, one aspect of such problems is noted in CPPA data sheet No. G18 (Rev. November 1994), at page 9. However, it has been found that suitable weave patterns can be created using designs requiring 9 sheds or more, with advantageous results, and without the expected disadvantages.

Consequently, it has been found that the lengths of the exposed floats of the machine side layer weft yarns on the machine side surface of the machine side layer in a double layer forming fabric can be increased. The resultant increased volume of weft material which is subjected to the abrasive forces of the machine can significantly extend the operational life of the forming fabric.

The present invention therefore seeks to provide a double layer forming fabric for a paper making machine, having increased resistance to machine side layer wear and abrasion. The invention provides for relatively long machine side layer weft yarn floats in the machine side surface, which are exposed to the abrasive wear experienced by the forming fabric as it is running in contact with the various stationary and moving elements in the forming section of the paper making machine. The invention also enables the use of larger diameter weft yarns than have previously been found feasible for use in double layer forming fabrics.

The present invention also seeks to provide a double layer forming fabric having an improved balance between water drainage and paper solids retention. The invention provides substantially rectangular paper side layer frame openings, having substantially the same width in the machine direction. The regular spacing of the yarns forming the perimeters of the frame openings provides a high degree of uniformity of support for the paper making fibres, so that the resulting sheet has a substantially uniform appearance and structure.

The present invention still further seeks to provide a double layer forming fabric having a weave pattern which produces a substantial reduction in the twinning of the paper side layer weft yarns.

SUMMARY OF THE INVENTION

The present invention provides a double layer forming fabric for a paper making machine, woven to an overall repeating pattern, which comprises in combination (a) paper side layer weft yarns;

(b) machine side layer weft yarns; and (c) warp yarns, wherein (i) the paper side layer weft yarns interweave with the warp yarns in a first repeating weave pattern;

(ii) the machine side layer weft yarns interlace with the warp yarns in a second repeating weave pattern;

(iii) the fabric is woven in an overall repeating pattern requiring 3N-sheds, in which N is an integer and is at least 2;

(iv) for each warp yarn, the first repeating weave pattern includes interweaving locations comprising a first and a second interweaving point, each of said first and second interweaving points being separated by at least two paper side layer weft yarns;

(v) for each warp yarn, the second repeating weave pattern includes a series of interlacing points in which each interlaced machine side layer weft yarn also passes substantially below an interweaving location of paper side layer weft yarns and each adjacent warp yarn;

(vi) for each warp yarn, each of the first and second interweaving points with a paper side layer weft yarn is separated from an adjacent machine side layer interlacing point by at least two machine side layer weft yarns; and (vii) a machine side surface of the machine side layer includes exposed machine side layer weft yarn floats having a float length L defined as $L=3N-M$, wherein M is an integer and is at least 1.

In the double layer forming fabrics of this invention, each warp yarn is intrinsic to the weave pattern in both the paper side layer and the machine side layer of the fabric, so that each warp yarn contributes to the structural integrity and properties of both layers, particularly in relation to consistency in the paper support, and allows for long weft yarn floats in the machine side layer, thus increasing the operational life of the fabric.

Furthermore, in the double layer forming fabrics of this invention, each warp yarn follows an identical path, the weave pattern for each warp yarn being displaced from the weave pattern of adjacent warp yarns by an identical predetermined number of paper side layer and machine side layer weft yarns. Within each pattern repeat, the warp yarn path includes interweaving locations comprising pairs of interweaving points with the paper side layer weft yarns, and interlacing points with the machine side layer weft yarns, such that the interlacing points are approximately centralized between the second interweaving point of a preceding interweaving location and the first interweaving point of the next succeeding location. The displacement distance of one pair of interweaving points of one warp yarn from the preceding pair of interweaving points of the immediately preceding warp yarn, measured in terms of the predetermined number of paper side layer and machine side layer weft yarns, is selected so that the machine side interlacing points on one warp yarn are located approximately beneath a portion of an interweaving location on each adjacent warp yarn.

In addition, the warp yarns are arranged so that each warp yarn interlaces with the same machine side layer weft yarn as also interlaces with either the second preceding or second subsequent warp yarn. This enables the use of designs including relatively long external weft floats in the machine side surface of the machine side layer, by providing stability to the long weft floats which, by the increased wear volume in the machine side layer, contribute to the desired increased operational life of the fabric. Such designs include substantially regular frame openings on the paper side surface, which provides greater uniformity of the paper support.

Preferably, in all embodiments, each warp yarn has an internal float, between the machine side layer and the paper side layer, passing over at least two machine side layer weft yarns between each interlacing point with a machine side layer weft yarn and the immediately preceding and subsequent interweaving point in the paper side layer.

Preferably, the ratio of the number of paper side layer weft yarns to the number of machine side layer weft yarns is chosen from between 2:1 and 1:1, and more preferably the ratio is 2:1.

Preferably, the paper side layer weave pattern is selected from a satin weave design, or a twill or a broken twill weave design. More preferably the paper side layer weave pattern is a 3N×6N design, where 3N is the number of sheds. Where the ratio of the number of paper side layer weft yarns to the number of machine side layer weft yarns is 2:1, the machine side layer weave pattern would thus preferably be a 3N×3N design.

In the following description and claims, certain terms have the following meanings:

The term "paper side layer" refers to the layer of weft and warp yarns in the double layer forming fabric onto which the stock is deposited, and the associated term "paper side surface of the paper side layer" refers to the exposed surface of the paper side layer which directly supports the incipient paper web.

The term "machine side layer" refers to the layer of weft and warp yarns in the double layer forming fabric which is in contact with the support means of the paper making machine, and the associated term "machine side surface of the machine side layer" refers to the exposed surface of the machine side layer which is in direct contact with the stationary and rotating elements of the machine.

The term "machine direction" or "MD" refers to a line parallel to the direction of travel of the forming fabric when in use on the paper making machine, and the associated term "cross machine direction" or "CD" refers to a direction transverse to the machine direction.

The term "frame" refers to the substantially rectangular area defined by the longitudinal axis of four interwoven yarns in the paper side surface of the paper side layer of a forming fabric. The associated term "frame size" refers to the size determined by measurement from four selected yarns which define in plan view a distinct frame. This term is synonymous with the term "top surface open area" as used in CPPA Data Sheet No. G18 (Rev. Nov. 1994), at page 3. The associated term "frame opening" refers to the actual open area in between the yarns within a given frame in the paper side surface of the paper side layer of the fabric.

The term "fibre support index" refers to a calculation made according to the method described by Beran and summarized in CPPA data sheet No. G-18 (Rev. November 1994) at page 4; it provides an indication of the level of support given to the incipient paper web by the forming fabric. The method is further detailed in Helle, Torbjorn, "Fibre Web Support of the Forming Wire", *Tappi Journal*, supra at p. 115.

The term "interlace" refers to a locus at which a specific warp yarn wraps about a machine side layer weft yarn; the associated term "interweave" refers to a locus at which a specific warp yarn wraps about a paper side layer weft yarn.

The term "float" refers to a yarn which passes over a group of other yarns without interweaving or interlacing with them; the associated term "float length" refers to the length of a float, which can be expressed as a number indicating the number of yarns passed over.

The term "internal float" refers to a float which passes between the adjacent surfaces of the machine side layer and the paper side layer.

BRIEF DESCRIPTION OF THE DRAWINGS

The invention will now be described by way of reference to the drawings, in which.

DETAILED DESCRIPTION OF THE INVENTION

Figures 1, 2, 3, 4, 5:
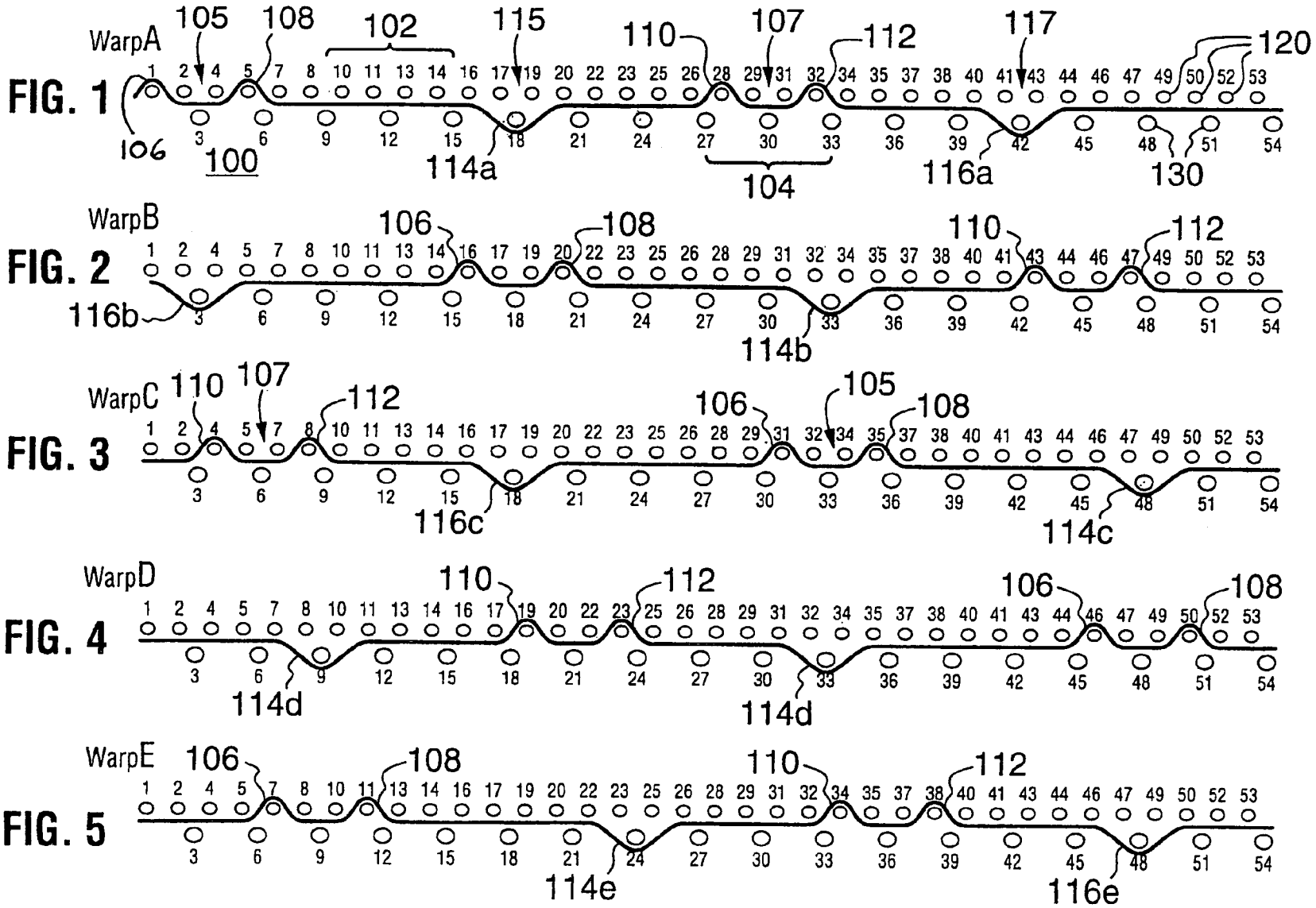
FIGS. 1 to 18 inclusive are sequential schematic cross-sectional views of a first embodiment of the invention, showing the paths of each successive warp yarn in one repeat of the forming fabric weave pattern.
Figure 6:
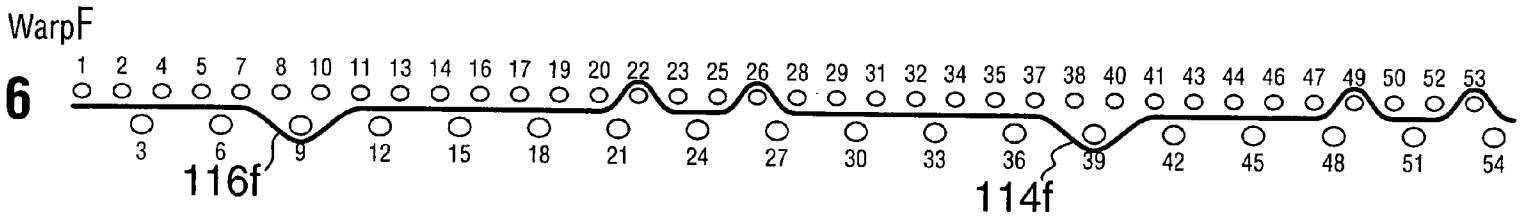
Figure 7:
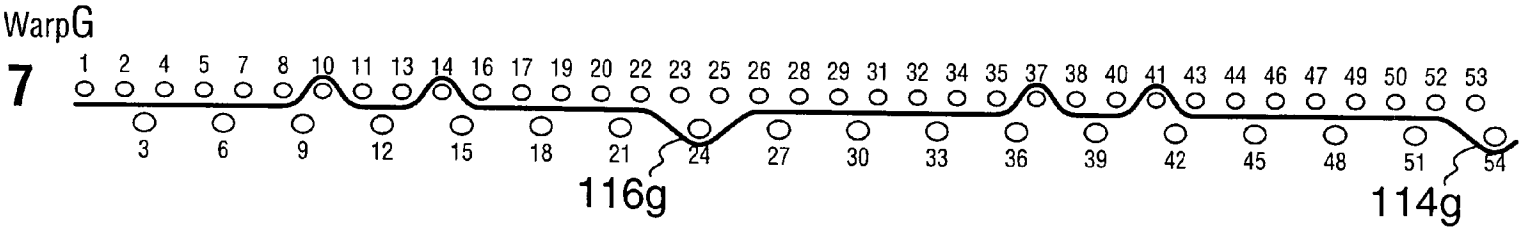
Figure 8:
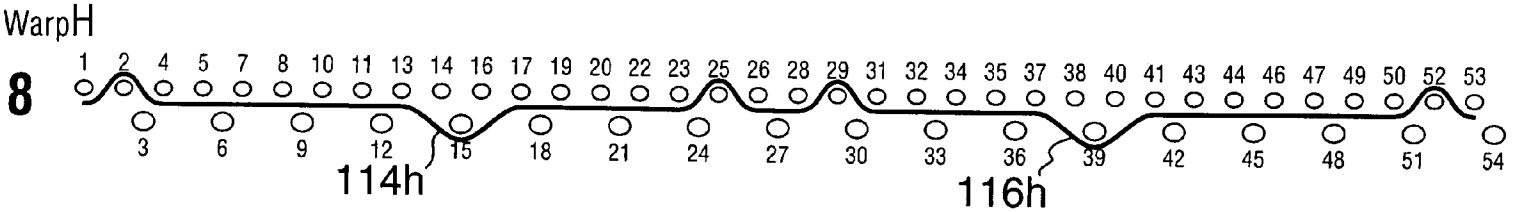
Figure 9:
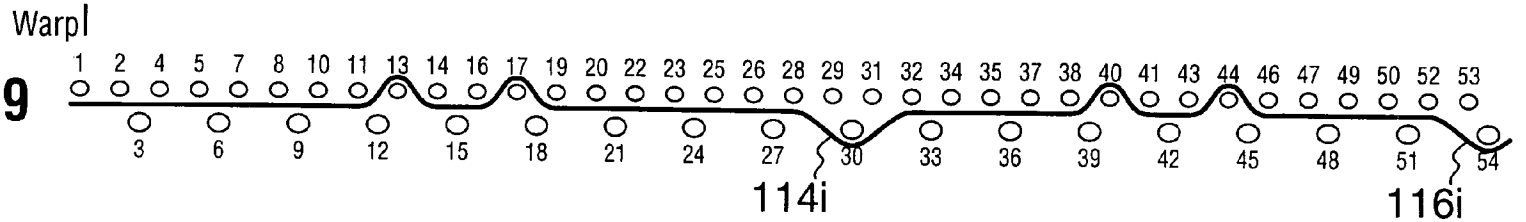
Figure 10:
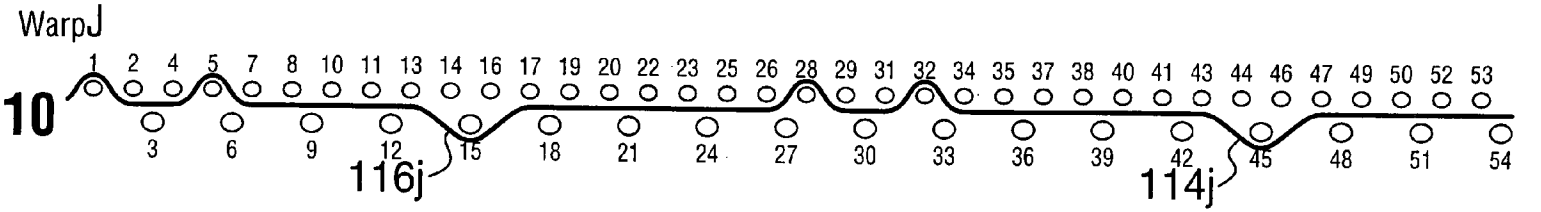
Figure 11:
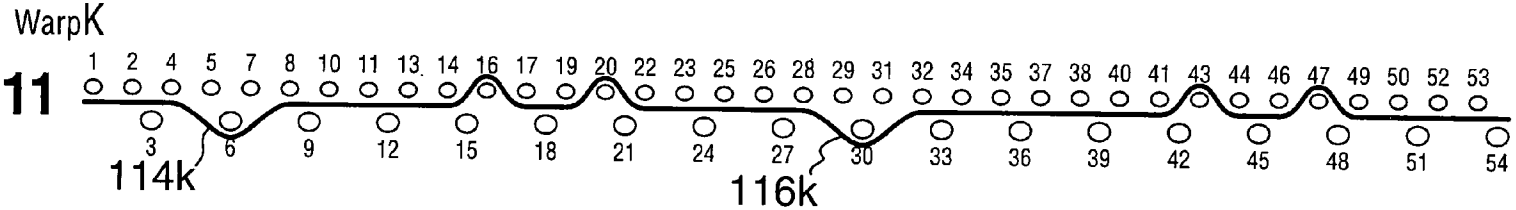
Figure 12:
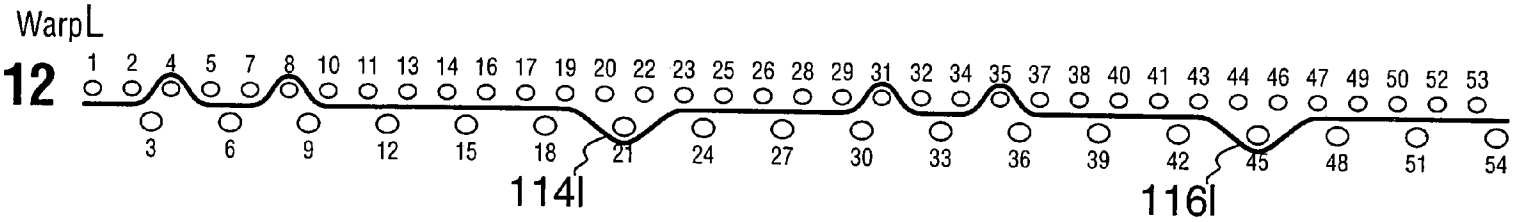
Figure 13:
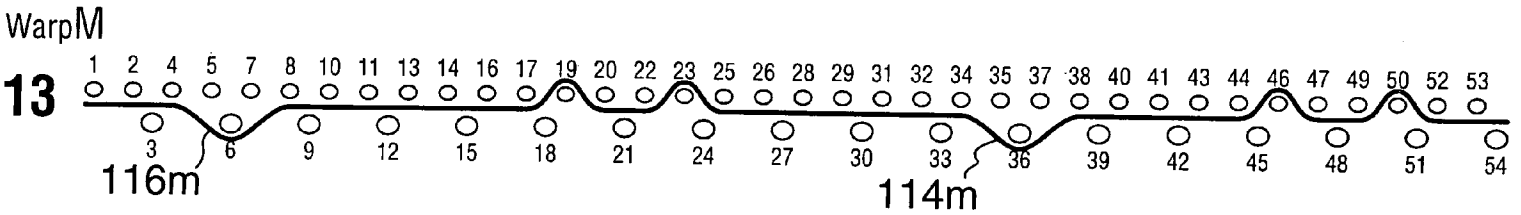
Figure 14:
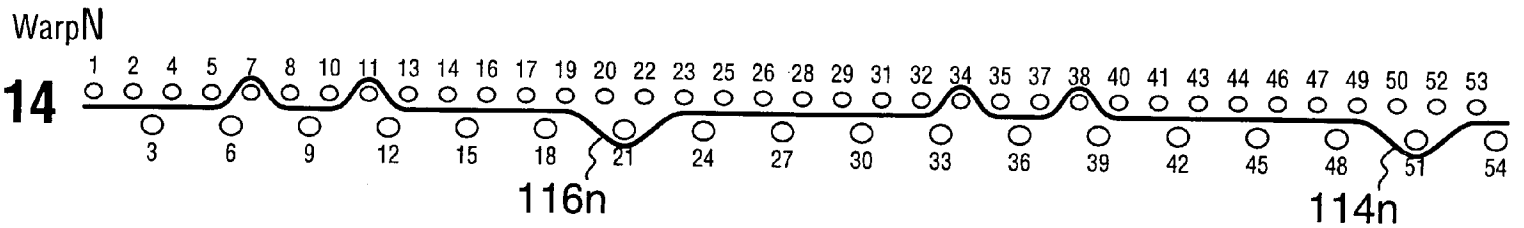
Figure 15:
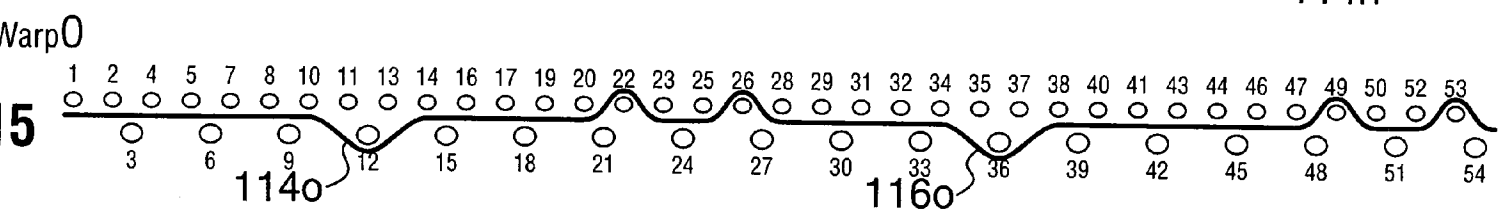
Figure 16:
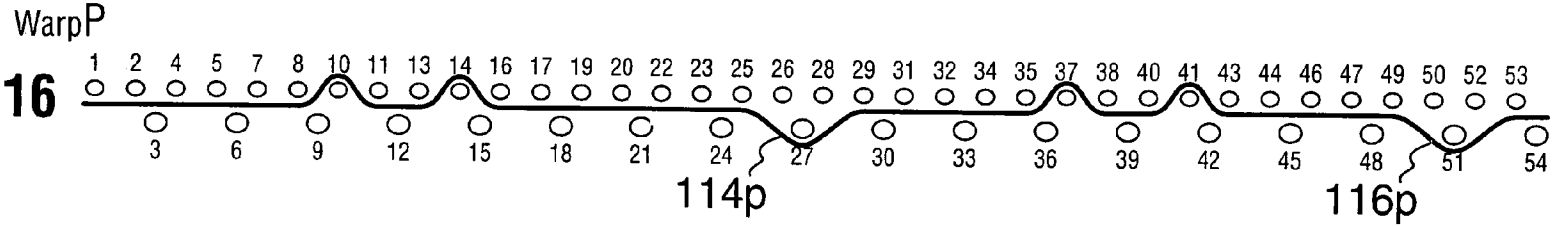
Figure 17:
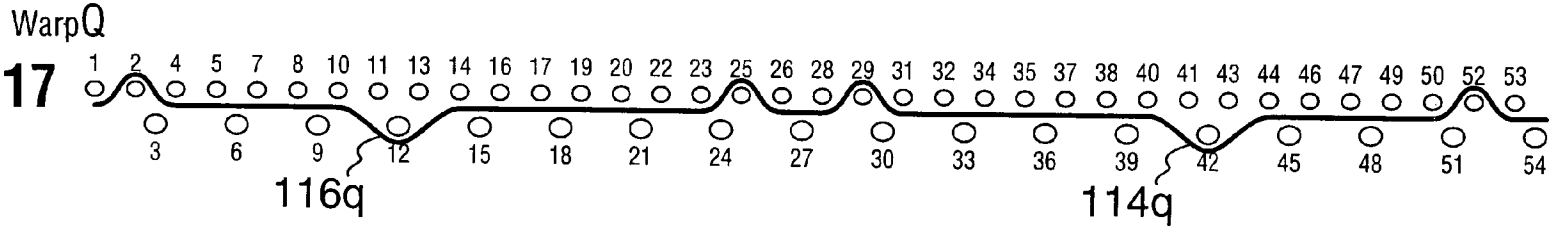
Figure 18:
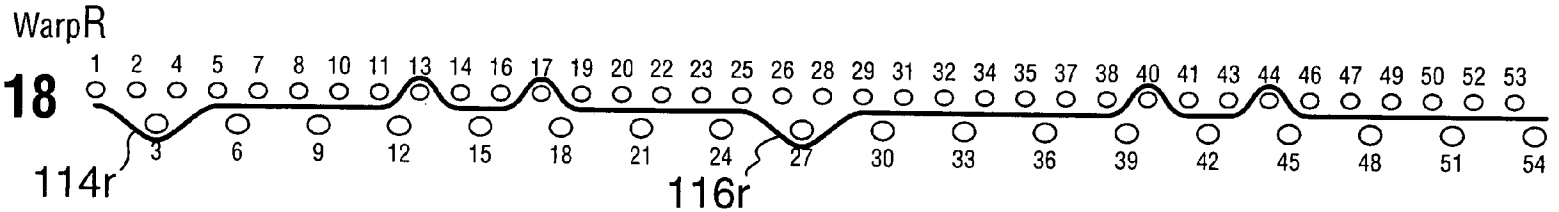

Referring first to FIGS. 1 to 18, these figures taken together show the path of each of eighteen single successive warp yarns 140 of the overall fabric repeat pattern of a first embodiment of the forming fabric 100 of the invention. The warp yarns 140 in consecutive figures are identified consecutively as warp yarn A, warp yarn B, warp yarn C up to and including warp yarn R. In each of FIGS. 1 to 18, the weft yarns 120 in the paper side layer 102 are shown in cross-section as the upper layer, and the weft yarns 130 in the machine side layer 104 are shown in cross-section as the lower layer. The two sets of weft yarns 120 and 130 are numbered from 1 to 54.

It can be seen that each warp yarn 140 follows an identical path, forming in one repeat of the paper side layer 102 weave pattern two interweaving locations 105 and 107, each comprising two interweaving points 106 and 108, and 110 and 112 (FIG. 1), and in one repeat of the machine side layer 104 weave pattern two interlacing points 114 and 116, shown for warp yarn A as 114*a*, 116*a*, for warp yarn B as 114*b*, 11,6*b* etc. In each repeat, reading from the left of the figures, interlacing point 114 follows interweaving point 108 and precedes interweaving point 110.

Referring to the path of warp yarn A shown in FIG. 1, at each interweaving location 105, each pair of interweaving points 106, 108 and 110, 112 respectively is separated by, and thus forms an internal warp float of, two paper side layer weft yarns 120, seen in FIG. 1 as paper side layer weft yarns 2 and 4, and 29 and 31.

Referring to FIGS. 1, 2 and 3, showing the paths of warp yarns A, B and C respectively, it will be seen that machine side layer weft yarn 3, which interlaces with warp yarn B at interlacing point 116*b*, also passes directly under the first interweaving location 105 of warp yarn A, which occurs at paper side layer weft yarns 1 and 5, and passes substantially under the first interweaving location 107 of warp yarn C, which occurs at paper side layer weft yarns 4 and 8.

Similarly, machine side layer weft yarn 33, which interlaces with warp yarn B at interlacing point. 114*b*, passes directly under the second interweaving location 105 of warp yarn C, which occurs at paper side layer weft yarns 31 and 35, and also passes substantially under the second interweaving location 107 of warp yarn A, which occurs at paper side layer weft yarns 28 and 32.

It can further be seen, referring to FIGS. 1 to 18, that for each of warp yarns A, B, C, and each succeeding warp yarn D to R, each first interlacing point 114*a*, 114*b*, 114*c* etc. is separated from both the immediately preceding interweaving point 108 and each succeeding interweaving point 110 on the same warp yarn by at least three machine side layer weft yarns 130. For example, in FIG. 1, first interlacing point 114*a* at machine side layer weft yarn 18 is separated from first interweaving point 108 at paper side layer weft yarn 5 by machine side layer weft yarns 6, 9, 12 and 15, and from second interweaving point 110 at paper side layer weft yarn 28 by machine side layer weft yarns 21, 24 and 27. Similarly, each second interlacing point 116*a*, 116*b*, 116*c* etc. is separated from the immediately preceding interweaving point 112 and each succeeding interweaving point 106 by at least three machine side layer weft yarns 130.

Still referring to FIGS. 1 to 18, it will further be noted that each machine side layer weft yarn 130 has an external float length in the machine side surface of the machine side layer of 15 warp yarns 140. For example, the machine side layer weft yarn 18 has an interlacing point 114*a* with warp yarn A, and a second interlacing point 116*c* with warp yarn C, but has no further interlacing points in the machine side layer weave pattern repeat, thus passing below and on the machine side of each of the fifteen warp yarns D to R. Similarly, machine side layer weft yarn 42 has an interlacing point 116*a* with warp yarn A, and a second interlacing point 114q with warp yarn Q, but no further interlacing points in the machine side layer weave pattern repeat, thus passing below and on the machine side of each of the fifteen warp yarns B to P.

It can further be seen that for any group of three adjacent warp yarns 140, in one repeat of the overall weave pattern, the first and third warp yarns 140 each interlace once, i.e., at either interlacing point 114 or interlacing point 116, but not both, with a common machine side layer weft yarn 130. Thus warp yarns A and C at their respective interlacing points 114*a* and 116*c* are separated by warp yarn B. Similarly, warp yarns Q and A at their respective interlacing points 114*q* and 116*a* are separated by warp yarn R. The effect of this aspect of the second repeating weave pattern can be seen in FIG. 20, where interlacing point 114 is indicated.

One result of this pattern of pairs of interlacing points 114 or 116 is an increase in the crimp differential of the machine side layer weft yarns 130 at these points, which causes them to bow outwards away from the machine side surface of the machine side layer 104, thus increasing their prominence. This results in an increase in the available wear volume of the machine side layer weft yarns 130 exposed to abrasion, thus increasing the operational life of the fabric.

Still referring to FIGS. 1 to 18, it will be seen that each successive warp yarn 140 follows an identical path, the pattern of which is displaced from the pattern of the immediately preceding warp yarn 140 by the same number of paper side layer weft yarns 120, and the same number of machine side layer weft yarns 130. For example, referring to FIGS. 1 to 4, the first interweaving point 106 of warp yarn A is with paper side layer weft yarn 1, and the first subsequent interweaving point 106 of warp yarn B is with paper side layer weft yarn 16. The first subsequent interweaving point 106 of warp yarn C is with paper side layer weft yarn 31, and the first subsequent interweaving point 106 of warp yarn D is with paper side layer weft yarn 46. Thus in this first embodiment, the displacement can be seen to comprise 10 paper side layer weft yarns 120, the subsequent interweaving point 106 being on the tenth paper side layer weft yarn 120 from the interweaving point 106 on the preceding warp yarn 140. Similarly, the displacement also comprises five machine side layer weft yarns 130, each interlacing point 114 or 116 being on the sixth machine side layer weft yarn 130 from the respective interlacing point 114 or 116 on the preceding warp yarn 140.

It can further be seen from FIGS. 1 to 18 that each interlacing point 114 in the machine side layer 104 is located respectively substantially below a central location 115 in the paper side layer 102 between the second interweaving point 108 and the next following interweaving point 110. Similarly, each interlacing point 116 in the machine side layer is located substantially below a central location between the second interweaving point 112 and the next following interweaving point 106. In the embodiment shown in FIGS. 1 to 18, the first central location 115 is separated from interweaving point 108 by eight paper side layer weft yarns 120, and from interweaving point 110 by six paper side layer weft yarns 120. The second central location 117 is separated from interweaving point 112 by six paper side layer weft yarns 120, and from the next following interweaving point 106 by eight paper side layer weft yarns 120. This arrangement of interlacing and interweaving points is constant for each of the warp yarns A to R in FIGS. 1 to 18.

Still referring to FIGS. 1 to 18, it can further be seen that in the repeating weave pattern of the paper side layer 102, the interweaving points are aligned so that for each interweaving location 105 or 107 on a selected warp yarn 140, comprising a pair of interweaving points 106, 108 or 110, 112, one interweaving point on each of the second preceding and second subsequent warp yarns 140 is located on a paper side layer weft yarn 120 between the paper side layer weft yarns with which the selected warp yarn 140 interweaves. For example, considering warp yarn C in FIG. 3 as being the selected warp yarn 140, the second interweaving location 105 comprises interweaving points 106 and 108 at paper side layer weft yams 31 and 35 respectively. The second preceding warp yarn 140 would be warp yarn A (FIG. 1), which has an interweaving point 108 with paper side layer weft yarn 5. The second subsequent warp yarn 140 is warp yarn E (FIG. 5), which has an interweaving point 106 with paper side layer weft yarn 7. Similarly for the second interweaving location 107 on warp yam C (FIG. 3), the interweaving points 110, 112 are with paper side layer weft yarns 31 and 35. The corresponding interweaving point 112 on warp yarn A (FIG. 1) is with paper side layer weft yarn 32, and the corresponding interweaving point 110 with warp yam E (FIG. 5) is with paper side layer weft yarn 34. A similar pattern can be identified in considering the interweaving points 106, 108 and 110, 112 on each warp yarn 140.

Figure 21:
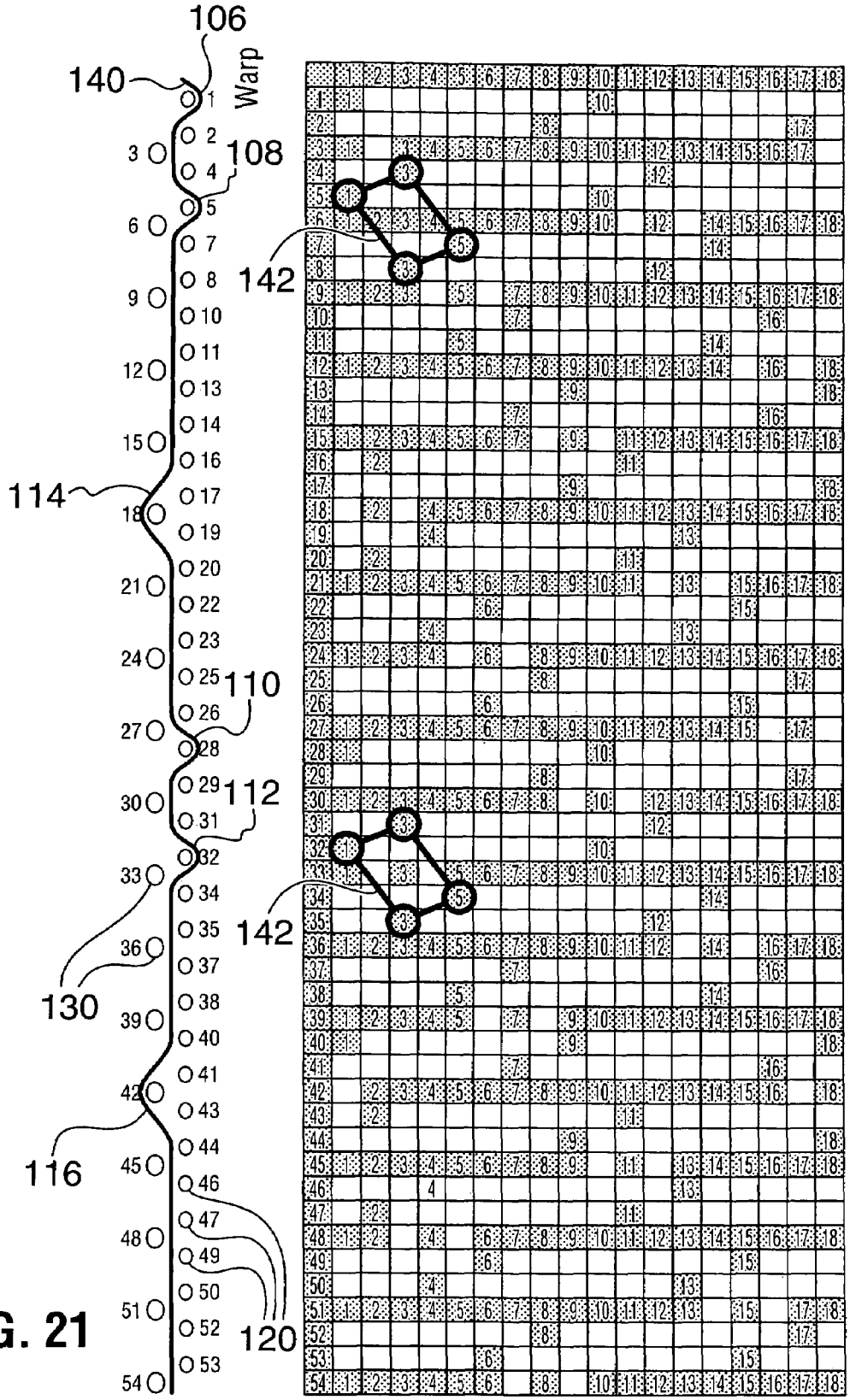
FIG. 21 is a weave diagram of the first embodiment of the invention.

It can further be seen from FIG. 21 that this spatial relationship of interweaving points 106, 108, and 110, 112 on successive alternate warp yarns 140 comprises a series of substantially rhomboid bracing zones 142, of identical configuration. Two examples are shown in FIG. 21, in which warp yarns 1, 3 and 5 correspond with warp yarns A, C and E in FIGS. 1, 3 and 5.

The effect of these bracing zones 142 is to provide a bracing effect on the paper side layer weft yarns 120 at each interweaving location 105 and 107, which has been found to have the advantage of further reducing any tendency to twinning of pairs of paper side layer weft yarns 120.

As discussed above, the degree of twinning of pairs of yarns in the fabrics of the present invention can be reduced so that the ratio of the distance between twinned yarns and adjacent non-twinned yarns is less than 0.1:1, or 10% and is preferably between 0.05:1 and 0:1, or 5% to zero.

Referring to FIGS. 1 to 18, and FIG. 21, and as already noted above, the first embodiment thus comprises a forming fabric 100 having an overall repeating pattern requiring eighteen sequential warp yarn paths, and having a first repeating weave pattern, in the paper side layer 102, comprising 36 paper side layer weft yarns 120. The second repeating weave pattern, in the machine side layer 104, over the same distance comprises 18 machine side layer weft yarns 130. Thus the forming fabric of this embodiment can be seen as having a first repeating weave pattern of 3N by 6N, and a second repeating weave pattern of 3N by 3N. For the fabric of this embodiment, it can thus be seen that 3N is 18, and N=6.

In the first embodiment, shown in FIGS. 1 to 18 and 21, the ratio of the paper side layer weft yarns 120 to the machine side layer weft yarns 130 is 2:1.

The machine side layer weft yarns 130 are not necessarily of the same diameter as, and are preferably of a larger diameter than, the paper side layer weft yarns 120. Wilson, in U.S. Pat. No. 6,112,774, suggests that each CD yarn in the machine side layer may require to be substantially aligned with a CD yarn in the paper side layer. However, it has been found that although the 18 machine side layer weft yarns 130 occupy the same distance in the machine direction as the 36 paper side layer weft yarns 120, none of the machine side layer weft yarns is required to be aligned specifically with any of the paper side layer weft yarns 120.

Figure 19:
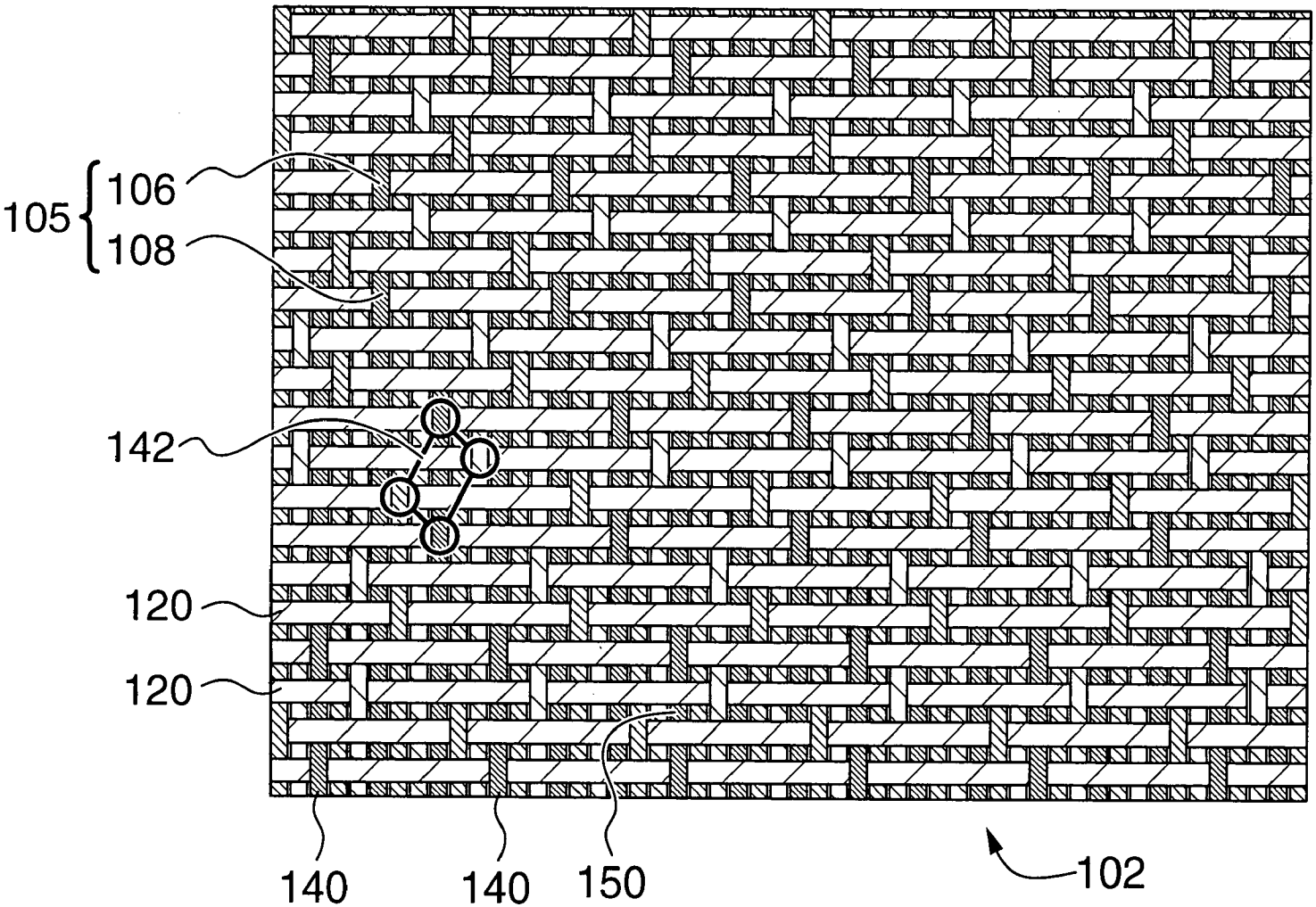
FIG. 19 depicts the paper side layer of the first embodiment of the invention.

Referring to FIG. 19, showing the paper side surface of the paper side layer 102, it can be seen that the first repeating weave pattern results in regular frame openings 150. As discussed above, this feature has been found to contribute to improved drainage properties of the paper side layer of a double layer forming fabric. It can further be seen that the substantially rectangular openings 150 are to some extent longer in the CD than in the MD. As discussed above, this feature contributes to CD support of the paper making fibres, which are predominantly MD oriented in the incipient paper web. The Beran's "b" figure used in the calculation of the fibre support index, as determined by the method described in the CPPA Data Sheet, noted above, for the fabrics of this invention is at least 0.8, and is more preferably between 0.8 and 1.0, and most preferably is 1.0, indicating that all of the paper side layer weft yarns 120 contribute to supporting the papermaking fibres.

Further referring to FIG. 19, a typical interweaving location 105, of paper side layer weft yarns 120 and warp yarns 140, comprises interweaving points 106 and 108. A bracing zone 142 is also shown.

Figure 20:
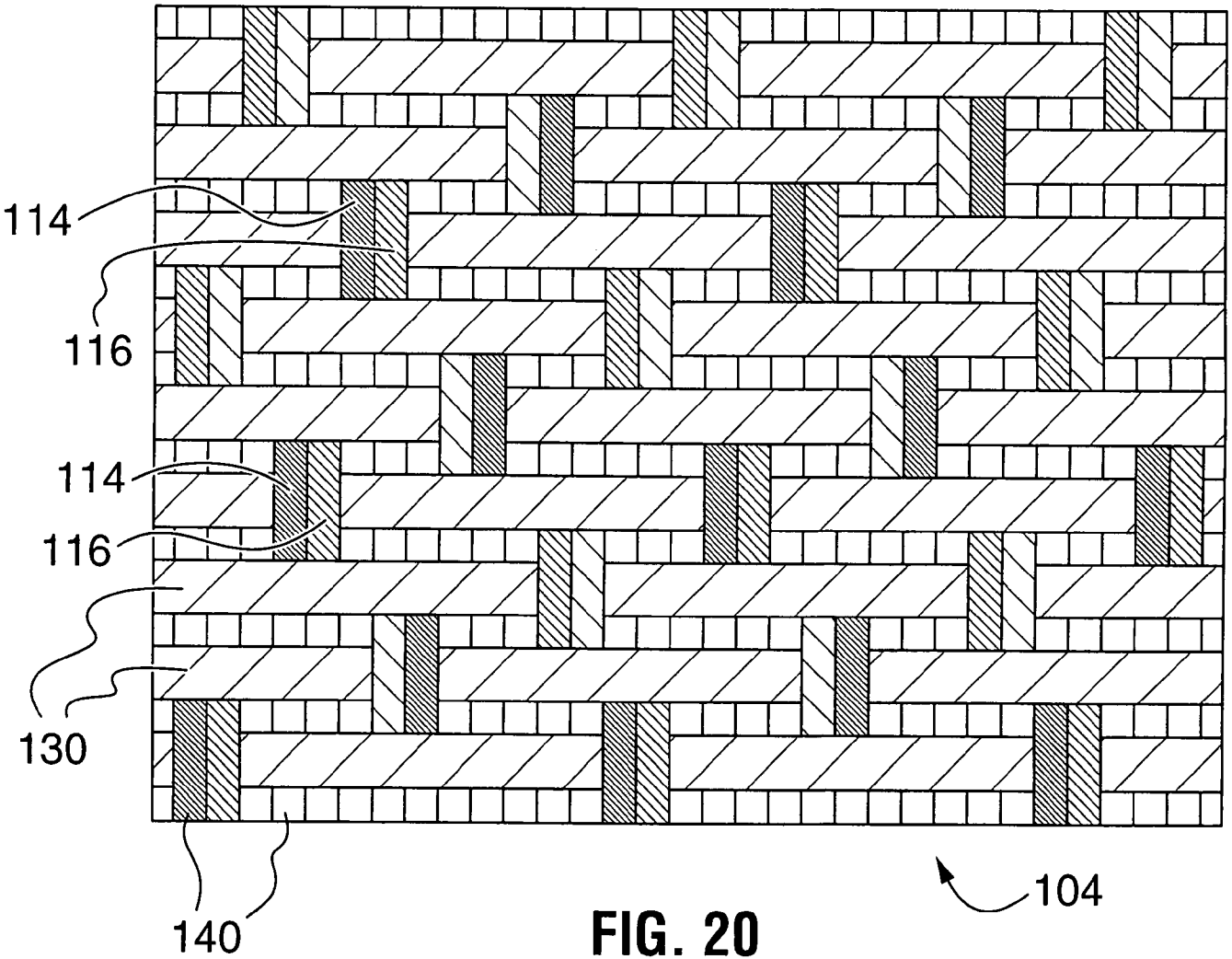
FIG. 20 depicts the machine side layer of the first embodiment of the invention.

Referring to FIG. 20, showing the machine side surface of the machine side layer 104, the interlacing points 114 and 116 of machine side layer weft yarns 130 and warp yarns 140 can be seen. By following the path of each warp yarn 140 on either side of an interlacing point 114 or 116, it can further be seen that each two warp yarns 140 which appear to be adjacent at their respective interlacing points 114 and 116 are in fact separated by a third warp yarn 140.

Figure 22:
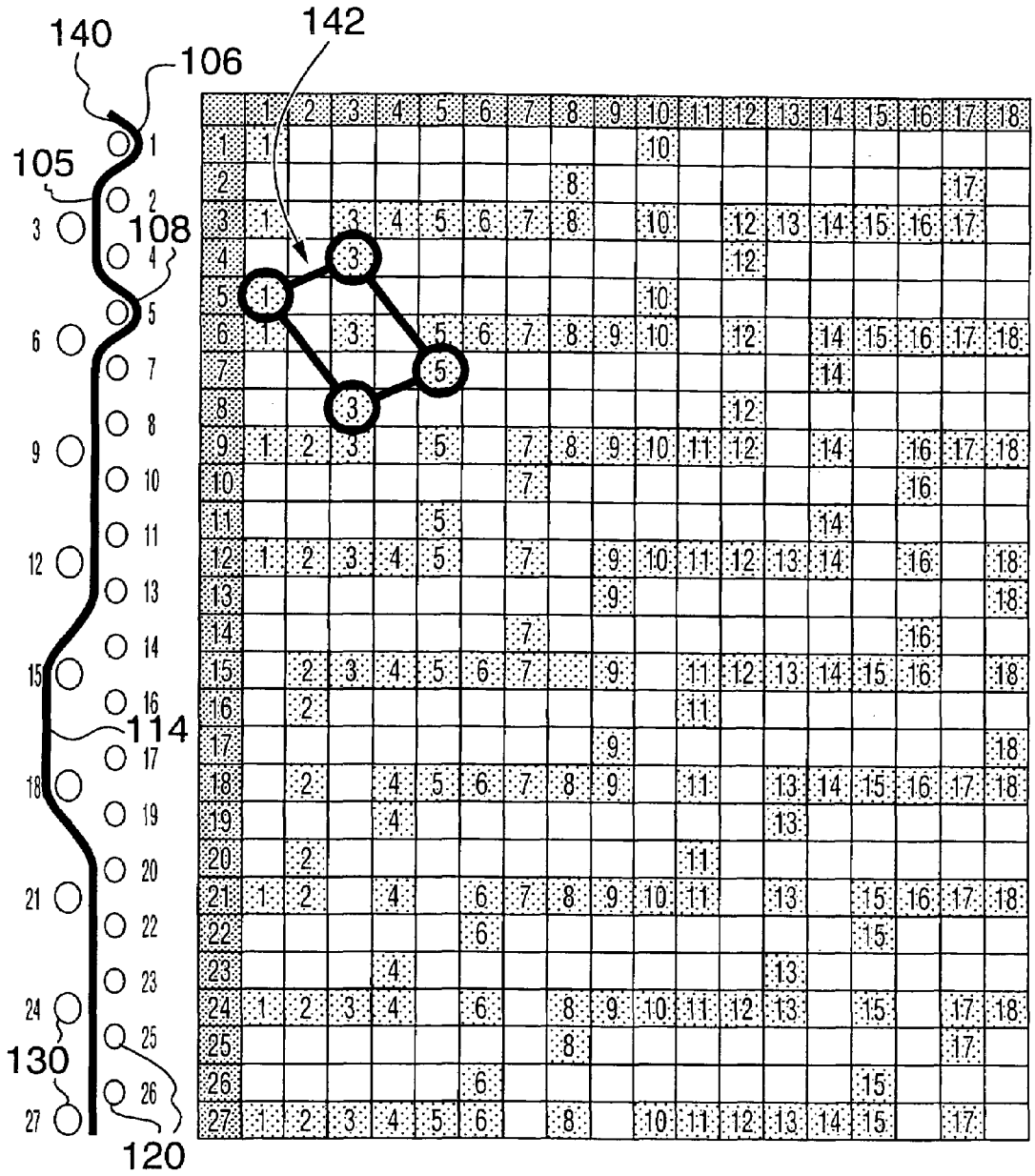
FIG. 22 is a weave diagram of a second embodiment of the invention, also showing the path of one warp yarn in one repeat of the forming fabric weave pattern.

A second embodiment of the double layer forming fabric of the invention is shown in FIG. 22. In this embodiment, the paper side layer 102 and the machine side layer 104 are each woven to a 9-shed satin weave pattern, for which N=3. The weave diagram of FIG. 22 shows one repeat in the MD and two repeats in the CD of both the paper side layer and machine side layer weave patterns. As can be more clearly seen from the diagram showing the path of one warp yarn 140, in each repeat of the repeating weave pattern in the paper side layer 102, there is a single interweaving location 105, at which each pair of interweaving points 106, 108 is separated by two paper side layer weft yarns 120. For example warp yarn 1 interweaves with paper side layer weft yarns 1 and 5, which are separated by paper side layer weft yarns 2 and 4. However, in this embodiment, at each interlacing point 114, each warp yarn 140 interlaces with an adjacent pair of machine side layer weft yarns, shown in the warp yarn path diagram of FIG. 22 as machine side layer weft yarns 15 and 18.

It can further be seen from FIG. 22 that for any three warp yarns 140, the first and third warp yarn 140 interlace with a common machine side layer weft yarn 130. Thus, for example, warp yarn 1 interlaces with machine side layer weft yarns 15 and 18, and warp yarn 3 interlaces with machine side layer weft yarns 18 and 21. Similarly, warp yarn 2 interlaces with machine side layer weft yarns 3 and 6, and warp yarn 4 interlaces with machine side layer weft yarns 6 and 9. As has already been noted in relation to the first embodiment, this pattern of double interlacing points 114 has been found to increase the crimp differential of the machine side layer weft yarns 130, causing them to become more prominent on the machine side surface of the machine side layer and, together with the effects of the longer float lengths of the machine side layer weft yarns 130, results in a corresponding increase in the operational life of the fabric.

It has been found that the interlacing of each warp yarn 140 with two adjacent machine side layer weft yarns 130 in this embodiment provides the additional advantage that a larger diameter yarn can be used for the machine side layer weft yarns, which can further increase the operational life of the fabric.

In this embodiment, in a similar manner to the first embodiment, the repeating weave pattern in the paper side layer 120 also includes bracing zones 142. For example, again referring to FIG. 22, warp yarn 3 interweaves with paper side layer weft yarns 4 and 8, warp yarn 1 interweaves with paper side layer weft yarn 5, and warp yarn 5 interweaves with paper side layer weft yarn 7.

Figure 23:
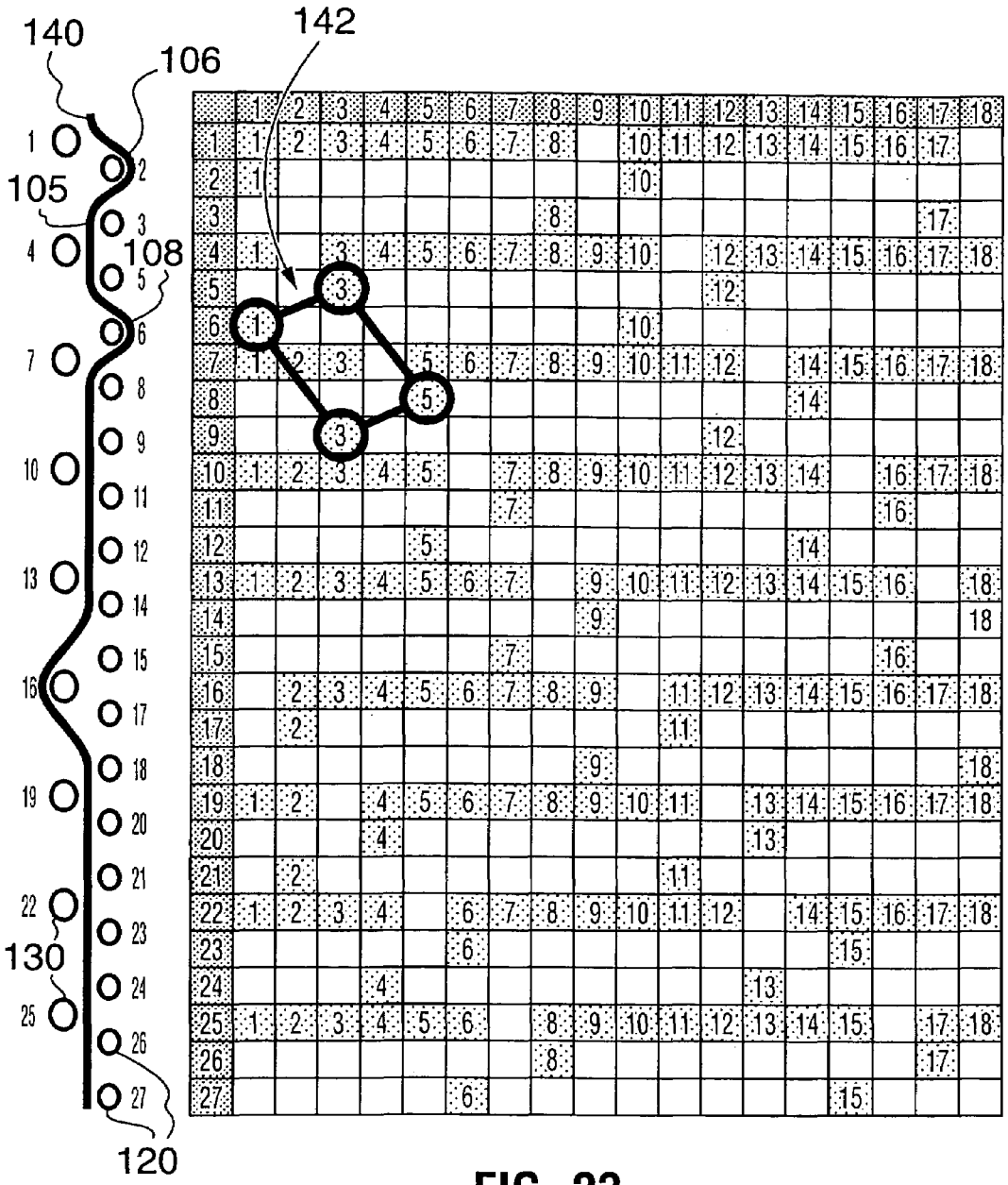
FIG. 23 is a weave diagram of a third embodiment of the invention, also showing the path of one warp yarn in one repeat of the forming fabric weave pattern.

A third embodiment of the double layer forming fabric of the invention is shown in FIG. 23. In this embodiment, the paper side layer 102 and the machine side layer 104 are each woven to a 9-shed satin weave pattern, for which N=3. The weave diagram of FIG. 23 shows one repeat in the MD and two repeats in the CD of both the paper side layer and machine side layer repeating weave patterns. In this embodiment, in each repeating weave pattern in the paper side layer 102, there is a single interweaving location 105, at which each pair of interweaving points 106, 108 is separated by two paper side layer weft yarns 120. For example, in FIG. 23, warp yarn 1 interweaves with paper side layer weft yarns 2 and 6, which are separated by paper side layer weft yarns 3 and 5.

In this embodiment, in a similar manner to the first and second embodiments, the repeating weave pattern in the paper side layer 120 also includes bracing zones 142. For example, again referring to FIG. 23, warp yarn 3 interweaves with paper side layer weft yarns 5 and 9, warp yarn 1 interweaves with paper side layer weft yarn 6, and warp yarn 5 interweaves with paper side layer weft yarn 8. It can be seen that the paper side layer 102 presents a uniform support surface for the incipient web, and has a fibre support index of approximately 1.

In this embodiment, the pattern of interlacing points 114 differs from that of the first two embodiments in that it does not include the interlacing of each of a first and third warp yarns 140 with a common machine side layer weft yarn 130. The pattern of this embodiment may require a somewhat reduced maximum diameter which can be used for the machine side layer weft yarns 130 than can be used for the first or second embodiments. However, any restriction on the extended operational life of the fabric can be offset by the increased wear potential which is derived from the float lengths of 8 for the machine side layer weft yarns 130.

The warp yarns 140 can be made of any suitable polymer material, and preferably have a substantially circular cross-section, although oval, elliptical and other geometric shaped cross-sections may be used. The dimensions of the warp yarns 140, the paper side layer weft yarns 120 and the machine side layer weft yarns 130 can be selected depending on factors including the intended end use, particularly the intended paper grade.

Experimental fabrics woven according to the various embodiments of the invention utilized machine side layer weft yarns 130 having a circular cross-section, and a diameter of 0.45 mm. These were either polyethylene terephthalate (PET), or alternating polyester and nylon-6 or nylon-6/6. Wear resistant yarns comprised of polymer blends of PET and thermoplastic polyurethane such as are disclosed by Bhatt et al, in U.S. Pat. No. 5,502,120, were also found effective in increasing the wear potential of the forming fabric of the invention. Yarn diameters ranging from 0.40 mm to 0.50 mm have been found to provide satisfactory results.

For the paper side layer weft yarns 120, a PET polyester was used having a circular cross-section and a diameter of 0.26 mm, but the results suggest that a range of 0.17 mm to at least 0.26 mm would give satisfactory results.

For the warp yarns 140, high modulus yarns were found to be particularly suitable, such as those comprised of polyethylene naphthalate (PEN). These yarns have a circular cross-section and a diameter ranging from 0.20 mm to 0.25 mm. Yarns made from these materials tend to retain their crimp particularly well following weaving and heatsetting, and the resulting fabrics exhibit a reduced propensity to stretch. Due to their high modulus, it is possible to use smaller yarns than comparable yarns of PET, while retaining comparable physical properties. This provides the possibility of using warp yarns 140 of PEN to reduce the warp fill and thus allow for more rapid drainage of water from the incipient web, if this is desired in a particular situation.

Those of skill in the art may vary the yarn sizes and materials used in the fabrics of the invention so as to accommodate the prevailing conditions and parameters of use in the particular paper making machine.

The fabrics of the invention will generally be woven flat, and subsequently cut and seamed in order to provide the required endless loop of fabric.

What is claimed is:

1. A double layer forming fabric for a paper making machine, woven to an overall repeating pattern having a machine direction (MD) and a cross-machine direction (CD), which fabric comprises in combination:

(a) paper side (PS) layer weft yarns oriented in the CD;

(b) machine side (MS) layer weft yarns oriented in the CD; and (c) machine direction (MD) oriented warp yarns, wherein (i) the PS layer weft yarns interweave with the warp yarns in a first repeating weave pattern;

(ii) the MS layer weft yarns interlace with the warp yarns in a second repeating weave pattern;

(iii) the overall repeating pattern requires 3N sheds, in which N is an integer and is at least 2;

(iv) for each repeat of the overall repeating weave pattern, each warp yarn forms two interweaving locations in the paper side layer alternated with two interlacing points in the machine side layer, such that (A) each interweaving location comprises a first and a second interweaving point separated by at least two paper side layer weft yarns;

(B) each interlacing point is located substantially centrally in relation to each adjacent interweaving point on the same warp yarn and separated therefrom by at least two MS weft yarns;

(C) each interweaving location is separated in the CD from each adjacent interweaving location by one warp yarn; and (D) for any group of three adjacent warp yams, one interlacing point for each of the first and third warp yarns is with a common MS layer weft yarn substantially below an interweaving location of the second warp yarn; and (v) a MS surface of the MS layer includes exposed MS layer weft yarn floats having a float length L defined as L=3N−M, wherein M is an integer and is at least 1.

2. A forming fabric according to claim 1 wherein for each warp yam, each interlacing point is separated from the adjacent interweaving point on the same warp yarn by at least three machine side layer weft yams.

3. A forming fabric according to claim 1 or claim 2 wherein each warp yarn follows an identical path.

4. A forming fabric according to claim 1 or claim 2, wherein the ratio of the number of paper side layer weft yarns to the number of machine side layer weft yarns is from 2:1 to 1:1.

5. A forming fabric according to claim 1 or claim 2, wherein the ratio is 2:1.

6. A forming fabric according to claim 1 or claim 2, wherein the first repeating weave pattern is a 3N by 6N pattern, and the second repeating weave pattern is a 3N by 3N pattern.

7. A forming fabric according to claim 1 or claim 2, wherein at each machine side layer interlacing point each warp yarn interlaces with a pair of adjacent machine side layer weft yams.

8. A forming fabric according to claim 1, wherein the material of construction of the machine side layer weft yarns comprises a wear resistant polymer.

9. A forming fabric according to claim 8, wherein the wear resistant polymer is selected from polyethylene terephthalate, nylon-6, nylon-6/6 and polymer blends.

10. A forming fabric according to claim 9, wherein the material of construction of the machine side layer weft yarns is a polymer blend and comprises polyethylene terephthalate and a thermoplastic polyurethane.

11. A forming fabric according to claim 1 or claim 2, wherein the material of construction of the warp yarns includes a polymer selected from polyethylene terephthalate and polyethylene naphthalate.

12. A forming fabric according to claim 1, having a fibre support index in respect of the paper side layer weft yarns in the range from 0.8 to 1.0.

13. A forming fabric according to claim 12, wherein the fibre support index is 1.0.

14. A forming fabric according to claim 1 or claim 2 wherein for any group of five adjacent warp yams, each interweaving location of the third warp yarn combines with an interweaving location of each of the first and fifth warp yarns to form a rhomboid bracing zone in the PS layer.

15. A forming fabric according to claim 1 or claim 2 wherein the first repeating weave pattern is a 3N by 6N pattern, the second repeating weave pattern is a 3N by 3N pattern and the overall repeating pattern requires 9 sheds or a multiple thereof in the loom.

* * * * *